United States Patent [19]

Parikh et al.

[11] 4,025,367

[45] May 24, 1977

[54] PROCESS FOR TREATING COPPER ALLOYS TO IMPROVE THERMAL STABILITY

[75] Inventors: Prakash D. Parikh; Eugene Shapiro, both of Hamden, Conn.

[73] Assignee: Olin Corporation, New Haven, Conn.

[22] Filed: June 28, 1976

[21] Appl. No.: 700,398

[52] U.S. Cl. ..... 148/11.5 C; 148/12.7 C

[51] Int. Cl.[2] ..... C22F 1/08

[58] Field of Search ..... 148/11.5 C, 12.7 C

[56] References Cited

UNITED STATES PATENTS

| | | | |
|---|---|---|---|
| 3,464,865 | 9/1969 | Eichelman, Jr. | 148/11.5 C |
| 3,475,227 | 10/1969 | Caule et al. | 148/11.5 C |
| 3,841,921 | 10/1974 | Shapiro et al. | 148/11.5 C |
| 3,852,121 | 12/1974 | Crane et al. | 148/11.5 C |

*Primary Examiner*—W. Stallard

*Attorney, Agent, or Firm*—Robert A. Dawson; Robert H. Bachman

[57] ABSTRACT

A process for improving the thermal stability of copper alloys having a low stacking fault energy is disclosed which comprises cold working the alloy, heating the alloy at a first temperature of from 100° to 300° C, additionally heating the alloy at a second temperature of from 200° to 360° C and cooling to room temperature. The second temperature must be higher than the first temperature.

19 Claims, No Drawings

PROCESS FOR TREATING COPPER ALLOYS TO IMPROVE THERMAL STABILITY

BACKGROUND OF THE INVENTION

This invention relates to a process for improving the thermal stability of copper base alloys having a low stacking fault energy. This thermal stability is evident in an improvement in both the creep resistance and the stress relaxation resistance of the alloys. It is a desirable objective to be able to process copper base alloys in such a manner so at to provide suitable spring properties for use in electrical connectors and like components. The properties of the materials which are required for obtaining suitable performance in electrical contactors or connectors are diverse. Aside from stress corrosion and electrical conductivity requirements specifically applicable to most parts of this type, they also require that either good contact be maintained during service or that a given stress produce a given deflection. In most of these parts the load is cycled and, as a consequence on reloading, the previously mentioned requirements must still be met.

It is known that materials can exhibit a time dependent strain under a stress that is below the yield strength as determined by engineering methods or as restrained may undergo a reduction stress. The former characteristic is called creep and the latter characteristic is referred to as stress relaxation. In spring loaded parts, it is therefore a desirable feature of an alloy system that it exhibit high creep resistance and high stress relaxation resistance under the highest desirable loads possible.

U.S. Pat. No. 3,841,921 teaches that stress relaxation resistance and creep resistance of low stacking fault energy copper base alloys can be improved by a low temperature thermal treatment. Such a treatment provides an improvement in the stiffness characteristics of the low stacking fault energy alloys.

SUMMARY OF THE INVENTION

In accordance with this invention, a process has been developed for improving the creep resistance and stress relaxation resistance of copper base alloys having a low stacking fault energy. Such a process therefore increases the thermal stability of such copper base alloys. The present invention is an improvement upon the low temperature thermal treatment of such copper base alloys found in U.S. Pat. No. 3,841,921.

The alloys to which this invention is applicable contain as a first element a metal selected from the group consisting of about 2 to 12 percent aluminum, about 2 to 6 percent germanium, about 2 to 10 percent gallium, about 3 to 12 percent indium, about 1 to 5 percent silicon, about 4 to 12 percent tin, about 8 to 37 percent zinc, and the balance essentially copper. The alloy system may further include other additions such as, for example, a second element different from the first element and selected from the group consisting of about 0.001 to 10 percent aluminum, about 0.001 to 4 percent germanium, about 0.001 to 8 percent gallium, about 0.001 to 10 percent indium, about 0.001 to 4 percent silicon, about 0.001 to 10 percent tin, about 0.001to 37 percent zinc, about 0.001 to 25 percent nickel, about 0.001 to 0.4 percent phosphorus, about 0.001 to 5 percent iron, about 0.001 to 5 percent cobalt, about 0.001 to 5 percent zirconium, about 0.001 to 10 percent manganese and mixtures thereof. Preferred ranges for these various elements are specified in the detailed description. It should be noted that all percentages presented herein are weight percentages.

The alloys thus provided have a low stacking fault energy which is generally less than 30 ergs per square centimeter. In accordance with this invention, the alloys are cold worked from about 10 to 97 percent and then subjected to a two-step thermal treatment where the first step is at a first temperature of from 100°to 300° and the second step is at a second temperature of from 200° to 360° C, provided that said second temperature is higher than said first temperature, followed by cooling to room temperature. The alloys as thus treated have improved resistance to creep and stress relaxation.

In accordance with another embodiment of this invention, intermediate cold working and annealing steps amy be interposed before the aforenoted cold working and heating step.

Accordingly, it is a principal object of the present invention to provide a process for improving the thermal stability, including creep resistance and stress relaxation resistance, of copper base alloys having a low stacking fault energy.

It is a further object of the present invention to provide a process as noted above which includes a multistep low temperature thermal treatment which provides said improvements.

Other objects and advantages of the present invention will appear from the following detailed description.

DETAILED DESCRIPTION

In accordance with the process of the present invention, an alloy consisting essentially of a first element selected from the group consisting of about 2 to 12 percent aluminum, about 2 to 6 percent germanium, about 2 to 10 percent gallium, about 3 to 12 percent indium, about 1 to 5 percent silicon, about 4 to 12 percent tin, about 8 to 37 percent zinc and the balance essentially copper is provided. The alloy thus provided is cold worked from about 10 to 97 percent, preferably from about 15 to 95 percent, then subjected to a multistep low temperature thermal treatment. This low temperature thermal treatment generally comprises two distinct heating phases, the first at approximately 100° to 300° C for 15 minutes to 8 hours and the second at 200° to 360° C for at least one minute. The second heating phase temperature must be higher than the temperature used in the first heating phase. This heat treatment is followed by cooling the alloy to room temperature.

The alloy system to which the process of this invention is applied may include further elements as additions. For example, the alloy system may include at least one second element different from the first element, the second element being selected from the group consisting of about 0.001 to 10 percent aluminum, about 0.001 to 4 percent germanium, about 0.001 to 8 percent gallium, about 0.001 to 10 percent indium, about 0.001 to 4 percent silicon, about 0.001 to 10 percent tin, about 0.001 to 37 percent zinc, about 0.001 to 25 percent nickel, about 0.001 to 4 percent phosphorus, about 0.001 to 5 percent iron, about 0.001 to 5 percent cobalt, about 0.001 to 5 percent zirconium, about 0.001 to 10 percent manganese and mixtures thereof.

With respect to the second element or elements, the use of aluminum, silicon, tin or zinc is effective to reduce the stacking fault energy of the alloy system. Nickel, iron, cobalt, zirconium and manganese are effective to reduce the grain size of the allow system. The nickel and manganese additions are also effective as solid solution hardeners without substantially affecting the stacking fault energy of the alloy system. Phosphorus acts both as a deoxidant and as a grain refiner, either by itself or in combination with the other elements.

The first element in the alloy system is preferably selected from the group consisting of about 2 to 10 percent aluminum, about 3 to 5 percent germanium, about 3 to 8 percent gallium, about 4 to 10 percent indium, about 1.5 to 4 percent silicon, about 4 to 10 percent tin and about 15 to 37 percent zinc.

The second element in the alloy system is preferably selected from the group consisting of about 0.01 to 4 percent aluminum, about 0.01 to 3 percent germanium, about 0.01 to 7 percent gallium, about 0.01 to 9 percent indium, about 0.01 to 3.5 percent silicon, about 0.01 to 8 percent tin, about 0.01 to 35 percent zinc, about 0.01 to 20 percent nickel, about 0.01 to 0.35 percent phosphorus, about 0.01 to 3.5 percent iron, about 0.01 to 2 percent cobalt, about 0.01 to 3.5 percent zirconium and about 0.01 to 8.5 percent manganese.

The alloy system utilized in the process of the present invention may be subjected to one or more series of cold working and intermediate annealing steps prior to the cold working and low temperature thermal treatment described above. In this series, the alloys are provided as in accordance with the elements described above and are then cold worked from about 10 to 97 percent, preferably from about 15 to 95 percent. This cold working step is followed by intermediate annealing for at least one minute at a temperature of 300° to 750° C so as to recrystallize the alloys. This intermediate annealing step is preferably at a temperature of 350° to 700° C. This series of cold working and intermediate annealing steps may be repeated as often as desired to obtain the desired gage and temper in the final material.

Following this series, the worked alloy is processed as previously described, namely it is cold worked from about 10 to 97 percent, preferably from about 15 to 95 percent, then heated to a first temperature of 100 to 300° C for 15 minutes to 8 hours, then heated to a second temperature of 200° to 360° C for at least one minute, provided that said second temperature is higher than said first temperature, followed by cooling to room temperature.

The alloy may be formed into a desired final article before being subjected to the multiple heat treatments. The multiple heat treatments may also be employed between the cold working steps and the forming step, in conjunction with a further multiple heat treatment process after the forming step to obtain the desired thermal stability of the alloy being worked.

The low temperature thermal treatment is carried out in the temperature range where recovery, but not recrystallization, occurs in the alloy system. For eventual commerical practices, it is desirable that the temperature range of the heat treatments should be fairly wide for ease of furnace heat treatment control. Upper temperature limits for the heat treatment are set by undue softening of the alloys as recrystallization occurs. This phenomenon causes a change in or loss of temper. It is desirable to provide a method of conducting the low temperature heat treatment which prevents or delays unwanted softening in the alloy system. In addition, for alloys containing between one and nine percent aluminum or between 20 and 30 percent zinc, a short range ordering reaction occurs in the low temperature heat treatment range which provides strengthening of the alloys at the expense of stress corrosion resistance. When stress corrosion resistance is desired, these alloys have a restrictive low temperature annealing range bounded on the high side by softening and on the low side by unwanted order hardening. Cold working of the alloys decreases the softening temperature thereof. Accordingly, the hardest alloys most desirable for mechanical strength propreties may not be amenable to commercial annealing in this low temperature range. It would be desirable to postpone softening of the alloys so as to widen the operating range of the low temperature heat treatment.

The present invention embodies a new and unique method of performing the low temperature heat treatment step so that the softening resistance of the alloy being treated is enhanced, thus widening the acceptable range for the low temperature heat treatment to improve the stress relaxation and creep properties of the alloys. This enhanced softening resistance provided by the heat treatment of the present invention may also be utilized when resistance to elevated temperatures is contemplated for the alloy system.

The present invention will be more readily understood from a consideration of the following illustrative Example.

EXAMPLE I

CDA (Copper Development Association Alloy 688 22.7 percent zinc, 3.4 percent aluminum, 0.4 percent cobalt, balance copper). 688 was cold worked and subjected to different heat treatments. One of these heat treatments was performed at a temperature of 125° C for 2 and 8 hours. The second set of heat treatments was performed according to the present invention and included heat treating at 200° C for 4 hours followed by 290° C for 4 hours as well as 200° C for 4 hours followed by 290° C for 8 hours. The last set of heat treatments was performed at 275° C for 4 hours, another at 290° C for 1 hour and another at 290° C for 4 hours. The strength properties and bending ability of CDA Alloy 688 for each set of heat treatments are shown in Table I.

The results of the various heat treatments, as shown in Table I, indicate that the 125° C heat treatment has a disastrous effect upon the bending ability of the alloy. The increase in the 0.2% YS and UTS for the 125° C treatment suggests an ordering reaction within the alloy. A comparison of the duplex heat treatment of the present invention with the 275° and 290° C heat treatments indicate that the duplex treatment yields improved thermal stability and formability for the alloy system. The data of Table I suggests that the duplex heat treatment provides greater commercial potential for stabilization annealing while broadening the temper availability and annealing parameters for the alloy system.

TABLE I

| Comparative Results from Different Heat Treatments for CDA Alloy 688 | | | | | | | |
|---|---|---|---|---|---|---|---|
| Heat Treatment | Modulus E × $10^6$, psi | 0.01% YS, psi | 0.2% YS, psi | UTS, psi | % Elong. | Min. Bend Radius 1/64" long. | trans. |
| none | 14.6 | 55,000 | 106,000 | 122,000 | 3 | 7 | 12 |
| 125°C/2 hrs. | — | 70,000 | 115,000 | 125,500 | 6 | >16 | >16 |
| 125°C/8 hrs. | — | 68,000 | 115,000 | 128,000 | 6 | >16 | >16 |
| 200°C/4 hrs. + 290°C/4 hrs. | 16.7 | 78,000 | 110,000 | 118,000 | 3 | 8 | 7 |
| 200°C/4 hrs. + 290°C/8 hrs. | 17.8 | 68,000 | 101,000 | 111,000 | 7 | 7 | 5 |
| 275°C/4 hrs. | 16.8 | 97,000 | 124,000 | 130,000 | 2 | 12 | >16 |
| 290°C/1 hr. | 17.0 | 83,000 | 112,000 | 120,000 | 3 | 8 | 12 |
| 290°C/4 hrs. | 16.5 | 68,000 | 90,000 | 103,000 | 2 | 3 | 4 |

The data shown in Table I also indicate that the heat treatment of the present invention provides a combination of stress relaxation resistance as shown by the 0.01% YS values and good formability as shown by the minimum bending radius values. The multiple heat treatment of the present invention experiences a lower loss in 0.01% yield strength than does a single heating of the alloy being tested at the same temperature range. It is known in the art (e.g., Fox, A. "Stress Relaxation and Fatigue of Two Electromechanical Spring Materials Strengthened by Thermomechanical Processing", IEEE Transactions, Vol. PMP-7, No. 1, March, 1971, pp. 34–47) that a lowering of 0.01% yield strength values is directly related to the stress relaxation potential of the material. Therefore, the process of the present invention provides a means for improving the thermal stability of copper base alloys by improving their creep resistance and stress relaxation resistance.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for improving the thermal stability of copper base alloys having low stacking fault energy without significantly degrading tensile properties comprising:

a. providing a copper base alloy having a stacking fault energy of less than 30 ergs per square centimeter consisting essentially of a first element selected from the group consisting of about 2 to 12% by weight aluminum, about 2 to 6% by weight germanium, about 2 to 10% by weight gallium, about 3 to 12% by weight indium, about 1 to 5% by weight silicon, about 4 to 12% by weight tin, about 8 to 37% by weight zinc, balance copper;

b. cold working said alloy from about to 97%, 97%;

c. heating said alloy without significantly degrading the tensile properties thereof to a first temperature of from about 100° to 300° C for 15minutes to 8 hours;

d. further heating said alloy without significantly degrading the tensile properties thereof to a second temperature of from about 200° to 360° C for at least 1 minute, provided that said second temperature is higher than said first temperature; and e. cooling said alloy to room temperature.

2. A process according to claim 1 including the following step subsequent to said cold working step (b) but prior to said heating step (c):

f. forming said alloy into a desired final article.

3. A process according to claim 2 including the following steps subsequent to said cold working step (b) but prior to said forming step (f):

g. heating said alloy without significantly degrading the tensile properties thereof;

H further heating said alloy without significantly degrading the tensile properties thereof to a temperature of from about 200° to 360° C for at least 1 minute, provided that said further heating is at a higher temperatue than the heating of step (g).

4. A process according to claim 1 wherein said alloy includes at least one second element, different from said first element, said second element selected from the group consisting of about 0.001 to 10% by weight aluminum, about 0.001 to 4% by weight germanium, about 0.001 to 8% by weight gallium, about 0.001 to 10% by weight indium, about 0.001 to 4% by weight silicon, about 0.001 to 10% by weight tin, about 0.001 to 37% by weight zinc, about 0.001 to 25% by weight nickel, about 0.001 to 0.4% by weight phosphorus, about 0.001 to 5% by weight iron, about 0.001 to 5% by weight cobalt, about 0.001 to 5% by weight zirconium, about 0.001 to 10% by weight manganese and mixtures thereof.

5. A process according to claim 1 wherein said first element is selected from the group consisting of about 2 to 10% by weight aluminum, about 3 to 5% by weight germanium, about 3 to 8% by weight gallium, about 4 to 10% by weight indium, about 1.5 to 4% by weight silicon, about 4 to 10% by weight tin and about 15 to 37% by weight zinc.

6. A process according to claim 4 wherein said second element is selected from the group consisting of about 0.001 to 4% by weight aluminum, about 0.01 to 3% by weight germanium, about 0.01 to 7% by weight gallium, about 0.01 to 9% by weight indium, about 0.01 to 3.5 % by weight silicon, about 0.01 to 8% by weight tin, about 0.01 to 35% by weight zinc, about 0.01to 20% by weight nickel, about 0.01 to 0.35% by weight phosphorus, about 0.01 to 3.5% by weight iron, about 0.01 to 2% by weight cobalt, about 0.01 to 3.5% by weight zirconium and about 0.01 to 8.5% by weight manganese.

7. A process according to claim 1 wherein said alloy is cold worked from about 15 to 95%.

8. A process according to claim 1 wherein said heating step (d) is for at least 15 minutes.

9. A process for improving the thermal stability of copper base alloys having a low stacking fault energy without signicantly degrading tensile properties comprising:

a. providing a copper base alloy having a stacking fault energy of less than 2 ergs per square centimeter consisting essentially of a first element selected from the group consisting of about 2 to 12% by weight aluminum, about 2 to 6% by weight germanium, about 2 to 10% by weight gallium, about 3 to 12 of by weight indium, about 1 to 5% by weight silicon, about 40 to 12% by weight tin, about 8 to 37 % by weight zinc, balance copper;

b. cold working said alloy from about 10 to 97%;

c. annealing said alloy for at least 1 minute at a temperature of from about 300° to 750° C so as to recrystallize said alloy;

d. cold working said alloy from about 10 to 97%;

e. heating said alloy without significantly degrading the tensile properties thereof to a first temperature of from about 100° to 300° C for 15 minutes to 8 hours;

f. further heating said alloy without significantly degrading the tensile properties thereof to a second temperature of from about 200° to 360° C for at least one minute, provided that said second temperature is higher than said first temperature; and g. cooling said alloy to room temperature.

10. A process according to claim 9 including the following step subsequent to said cold working step (d) but prior to said heating step (c):

h. forming said alloy into a desired final article.

11. A process according to claim 10 including the following step subsequent to said cold working step (d) but prior to said forming step (h):

i. heating said alloy without significantly degrading the tensile properties thereof to a first temperature of from about 100° to 300° C for 15 minutes to 8 hours;

j. further heating said alloy without significantly degrading the tensile properties thereof to a second temperature of from about 200° to 360° C for at least 1 minute, provided that said second temperature is higher than said first temperature.

12. A process according to claim 9 wherein said alloy includes at least one second element, different from said first element, said second element selected from the group consisting of about 0.001 to 10% by weight aluminum, about 0.001 to 4% by weight germanium, about 0.001 to 8% by weight gallium, about 0.001 to 10% by weight indium, about 0.001 to 4% by weight silicon, about 0.001 to 10% by weight tin, about 0.001 to 37% by weight zinc, about 0.001 to 25% by weight nickel, about 0.001 to 0.4% by weight phosphorus, about 0.001 to 5% by weight iron, about 0.001 to 5% by weight cobalt, about 0.001 to 5% by weight zirconium, about 0.001 to 10% by weight manganese and mixtures thereof.

13. A process according to claim 9 wherein said first element is selected from the group consisting of about 2 to 10% by weight aluminum, about 3 to 5% by weight germanium, about 3 to 8% by weight gallium, about 4 to 10% by weight indium, about 1.5 to 4% by weight silicon, about 4 to 10% by weight tin, and about 15 to 37% by weight zinc.

14. A process according to claim 12 wherein said second element is selected from the group consisting of about 0.01 to 4% by weight aluminum, about 0.01 to 3% by weight germanium, about 0.01 to 7% by weight gallium, about 0.01 to 9% by weight indium, about 0.01 to 3.5% by weight silicon, about 0.01 to 8% by weight tin, about 0.01 to 35% by weight zinc, about 0.01 to 20% by weight nickel, about 0.01 to 0.35% by weight phosphorus, about 0.01 to 3.5% by weight iron, about 0.01 to 2% by weight cobalt, about 0.01 to 3.5% by weight zirconium and about 0.01 to 8.5% by weight manganese.

15. A process according to claim 9 wherein said alloy is cold worked from about 15 to 95%.

16. A process according to claim 9 wherein said heating step (f) is for at least 15 minutes.

17. A process according to claim 11 wherein said heating steps (f) and (j) are for at least 15 minutes.

18. A process according to claim 9 wherein steps (b) and (c) are repeated at least once.

19. A process according to claim 11 wherein steps (b) and (c) are repeated at least once.

* * * * *

UNITED STATES PATENT OFFICE
CERTIFICATE OF CORRECTION

Patent No. 4,025,367 Dated May 24, 1977

Inventor(s) Prakash D. Parikh et al.

It is certified that error appears in the above-identified patent and that said Letters Patent are hereby corrected as shown below:

Column 1, line 12, delete "at" and insert --as--

Column 2, line 10, delete "300°" and insert --300°C--

Column 2, line 18, delete "amy" and insert --may--

Column 3, line 5, delete "allow" and insert --alloy--

Column 3, line 59, delete "steps" and insert --step--

Column 3, line 66, delete "commerical" and insert --commercial--

Column 4, line 63, between "and" and "formability" insert --bend--

Column 5, line 58, delete "to 97%, 97%" and insert --10 to 97%--

Column 6, line 25, delete "H" and insert --h.--

Column 6, line 29, delete "temperatue" and insert --temperature--

Column 6, line 53, delete "0.001" and insert --0.01--

UNITED STATES PATENT OFFICE

CERTIFICATE OF CORRECTION

Patent No. 4,025,367 Dated May 24, 1977

Inventor(s) Prakash D.Parikh et al.

It is certified that error appears in the above-identified patent and that said Letters Patent are hereby corrected as shown below:

Column 7, line 1, delete "signicantly" and insert —significantly—

Column 7, line 4, delete "2" and insert --30--

Column 7, line 9, delete "12 of" and insert --12% by--

Column 7, line 10, delete "40" and insert --4--

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*